US005410392A

United States Patent [19]

Landa

[11] Patent Number: 5,410,392

[45] Date of Patent: Apr. 25, 1995

[54] IMAGING SYSTEM WITH INTERMEDIATE TRANSFER MEMBERS

[75] Inventor: Benzion Landa, Edmonton, Canada

[73] Assignee: Indigo N.V., Rotterdam, Netherlands

[21] Appl. No.: 119,203

[22] PCT Filed: Mar. 26, 1991

[86] PCT No.: PCT/NL91/00050

§ 371 Date: Dec. 20, 1993

§ 102(e) Date: Dec. 20, 1993

[87] PCT Pub. No.: WO92/17825

PCT Pub. Date: Oct. 15, 1992

[51] Int. Cl.[6] ..... G03G 15/16; G03G 15/01

[52] U.S. Cl. ..... 355/271; 355/256

[58] Field of Search ..... 355/256, 271, 279

[56] References Cited

U.S. PATENT DOCUMENTS

| | | | |
|---|---|---|---|
| 3,838,919 | 10/1974 | Takahashi . | |
| 3,847,478 | 11/1974 | Young . | |
| 3,863,603 | 2/1975 | Buckley et al. . | |
| 3,959,574 | 5/1976 | Seanor et al. . | |
| 4,144,808 | 3/1979 | Iwasa et al. . | |
| 4,515,460 | 5/1985 | Knechtel . | |
| 4,518,976 | 5/1985 | Tarumi et al. . | |
| 4,585,319 | 4/1986 | Okamoto et al. . | |
| 4,684,238 | 8/1987 | Till et al. . | |
| 4,690,539 | 9/1987 | Radulski et al. . | |
| 4,708,460 | 11/1987 | Langdon . | |
| 4,794,651 | 12/1988 | Landa et al. . | |
| 4,974,027 | 11/1990 | Landa et al. . | |
| 5,150,161 | 9/1992 | Bujese | 355/256 |

FOREIGN PATENT DOCUMENTS

| | | | |
|---|---|---|---|
| 57-2048 | 1/1982 | Japan . | |
| 62-134674 | 6/1987 | Japan . | |
| 62-240987 | 10/1987 | Japan | 355/271 |
| 63-34572 | 2/1988 | Japan . | |
| 63-58376 | 3/1988 | Japan | 355/328 |
| 9004216 | 4/1990 | WIPO . | |
| 9014617 | 11/1990 | WIPO . | |

*Primary Examiner*—Joan H. Pendegrass

*Attorney, Agent, or Firm*—Sandler, Greenblum & Bernstein

[57] ABSTRACT

Imaging apparatus for printing an image on a substrate (42) from a latent image formed on a latent image bearing surface (16) including developing apparatus (22) for developing the latent image/with toner to form a developed toner image of a given size, a first intermediate transfer member (40) having a surface area large enough to accomodate the developed toner image, first transfer means for transferring the developed toner image from the latent image bearing surface (16) to the first intermediate transfer member (40), a second intermediate transfer member (47) having a surface area smaller than the surface area of the first intermediate transfer member (40), and second transfer means for transferring of said developed image from said first intermediate transfer member (40) to said second intermediate transfer member (47) and from said second intermediate transfer member (47) to said substrate (42). Preferably the second intermediate transfer means (47) is a cylinder having a diameter of less than 30 or 40 mm.

14 Claims, 8 Drawing Sheets

IMAGING SYSTEM WITH INTERMEDIATE TRANSFER MEMBERS

FIELD OF THE INVENTION

The present invention relates to image transfer techniques and apparatus for use in electrophotography.

BACKGROUND OF THE INVENTION

Various prior publications deal with the transfer of single and multiple powder and liquid toner images from a photoreceptor on which they are formed to an intermediate transfer member for subsequent transfer to a final substrate.

U.S. Pat. No. 3,838,919 to Takahashi describes a powder toner system in which color toner images are sequentially formed on an image forming member, individually transferred to an intermediate transfer member and transferred at one time to a recording member.

U.S. Pat. No. 4,144,808 to Isawa et al. describes a method of printing on a metal plate utilizing powder toner and an intermediate transfer member where the plate is heated before transfer.

U.S. Pat. No. 4,518,976 to Tarumi et al. describes a monochrome powder toner system in which a powder image is developed on a photoreceptor, and transferred electrostatically to an intermediate transfer member. Downstream this transfer, the intermediate transfer member and the image thereon are heated before transfer to a preheated substrate.

U.S. Pat. No. 4,515,460 to Knechtel, describes a powder toner apparatus wherein separate toner images are sequentially developed on a photoreceptor and electrostatically transferred to an intermediate transfer member. After all of the individual images have been transferred to the intermediate transfer member, they are transferred electrostatically to the final substrate. No heating of the images or substrate is disclosed.

U.S. Pat. No. 4,585,319 to Okamoto et al. describes a powder developer type, single color system, utilizing a temperature controlled photoreceptor, a heated intermediate transfer member and a heated transfer fixing roller which is heated to a temperature slightly higher than that of the intermediate transfer member.

U.S. Pat. No. 4,690,539 to Radulski et al. describes a liquid toner multi-color system in which a color image is developed on a photoreceptor and transferred to a belt type intermediate transfer member. The liquid carrier is removed from the toner image on the belt. There is no mention of heating the intermediate transfer member or of the problem of back transfer.

U.S. Pat. No. 4,708,460 to Langdon describes a single color liquid toner system in which a developed image is transferred from a photoreceptor to an intermediate transfer member, heated on the transfer member and then transferred to a final substrate.

U.S. Pat. No. 3,847,478 to Young describes a duplex printing system, wherein a developed image is transferred from a photoconductor to an intermediate transfer member, a second image is developed on the photoconductor and both images are transferred electrostatically to opposite sides of a piece of paper passed between the intermediate transfer member and the photoreceptor.

SUMMARY OF THE INVENTION

The present invention seeks to provide improved apparatus for the transfer of an image from an image bearing surface to an intermediate transfer member and subsequent transfer to a final substrate.

There is thus provided in accordance with a preferred embodiment of the invention imaging apparatus for printing an image on a substrate from a latent image formed on a latent image bearing surface including developing apparatus for developing the latent image with toner, preferably with liquid toner having carrier liquid and toner particles, to form a developed toner image of a given size, a first intermediate transfer member, preferably having a cylindrical shape and having a surface area large enough to accommodate the developed toner image, first transfer apparatus for transferring the developed toner image from the latent image bearing surface to the first intermediate transfer member, a second intermediate transfer member, preferably a cylindrical shape having a surface area smaller than the surface area of the first intermediate transfer member and second transfer apparatus for transferring of the developed image from the first intermediate transfer member to the second intermediate transfer member and from the second intermediate transfer member to the substrate.

Preferably the second intermediate transfer member is not large enough to accomodate the developed image.

In a preferred embodiment of the invention the imaging apparatus includes heating apparatus for heating the first intermediate transfer member to a first temperature and for heating the second intermediate transfer member to a second temperature higher than the first temperature.

Preferably the second transfer apparatus includes apparatus for heating the substrate, preferably including a heating backing roller operative to apply heat and pressure to the image during image transfer to the substrate.

In a preferred embodiment of the invention the imaging apparatus also includes first voltage apparatus for maintaining the first intermediate transfer member at a first voltage. Preferably at least a portion of the latent image bearing surface is at a second voltage and the first voltage is different from the second voltage. Preferably the imaging apparatus also includes second voltage means for maintaining the second intermediate transfer member at a third voltage.

Preferably the second intermediate transfer member has a diameter of less than about 40 mm, more preferably a diameter of less than about 30 mm.

In a preferred embodiment of the invention transfer of the developed image from the second intermediate transfer member to the substrate commences before transfer of the developed image from the first intermediate transfer member to the second transfer member is complete.

In a preferred embodiment of the invention the imaging apparatus includes means for producing a plurality of developed images on the image bearing surface and for transferring the plurality of developed images to the first transfer member in mutual alignment thereon.

BRIEF DESCRIPTION OF THE DRAWINGS

The present invention will be understood and appreciated more fully from the following detailed description, taken in conjunction with the drawings in which.

DETAILED DESCRIPTION OF PREFERRED EMBODIMENTS

Figure 1:
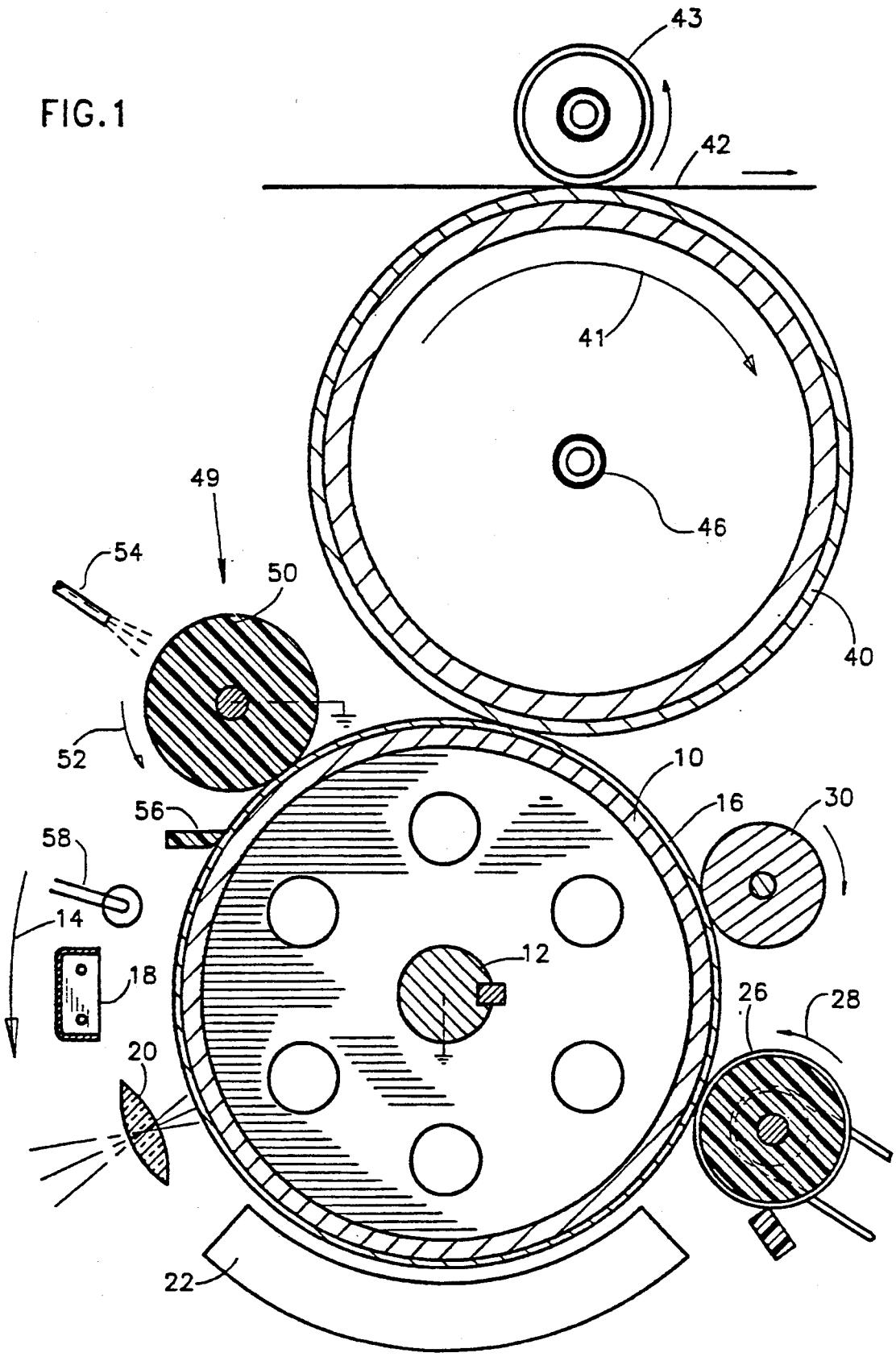
FIG. 1 is a simplified sectional illustration of electrophotographic apparatus constructed and operative in accordance with a preferred embodiment of the present invention.

Reference is now made to FIG. 1 which illustrates electrophotographic imaging apparatus constructed and operative in accordance with a preferred embodiment of the present invention. This and other embodiments of the invention are described in the context of liquid developer systems with negatively charged toner particles and positively charged photoreceptors. Such systems operate in a "write-white" mode, for which areas which are not to be toned are exposed to light. The invention may be useful for other combinations of toner charge, photoreceptor charge as well as for other writing systems, such as "write-black" systems.

The apparatus of the invention is described using a liquid developer system. In accordance with a preferred embodiment of the invention the liquid developer of Example 1 of U.S. Pat. No. 4,794,651 can be used, but other suitable developers may be used in the practice of the invention. Especially useful are liquid developers comprising toner particles which solvate the carrier liquid of the developer at elevated temperatures, above room temperature.

As in conventional electrophotographic systems, the apparatus of FIG. 1 comprises a drum 10 arranged for rotation about an axle 12 in a direction generally indicated by arrow 14. Drum 10 is formed with a cylindrical photoreceptor surface 16.

A corona discharge device 18 is operative to generally uniformly charge photoreceptor surface 16 with a positive charge. Continued rotation of drum 10 brings charged photoreceptor surface 16 into image receiving relationship with an exposure unit including a lens 20. Lens 20, focuses a desired image, which may be laser generated, onto charged photoreceptor surface 16, selectively discharging the photoreceptor surface, thus producing an electrostatic latent image thereon.

Continued rotation of drum 10 brings charged photoreceptor surface 16 bearing the electrostatic latent image into operative association with a development unit 22, operative to apply a liquid developer to develop the electrostatic latent image. For multicolor copying or printing, the development unit 22 can, for example, comprise a plurality of developers, one for each color, which are selectively engaged with the photoreceptor, as described, for example, in U.S. Pat. No. 4,690,539, which is incorporated herein by reference, or a single development station where the liquid toner is changed between colors, or any other suitable development system. In general this development process takes place at a relatively low temperature, namely approximately the temperature of the environment of the system.

In accordance with a preferred embodiment of the invention, following application of toner thereto, photoreceptor surface 16 passes a typically positively charged rotating roller 26, preferably rotating in a direction indicated by an arrow 28. Roller 26 functions as a metering roller and reduces the thickness of liquid on photoreceptor surface 16. Typically the spatial separation of roller 26 from photoreceptor surface 16 is about 50 microns.

Preferably the voltage on roller 26 is intermediate the voltages of the latent image areas and of the background areas on the photoreceptor surface. Typical voltages are: roller 26: +200 V, background area: +50 V and latent image areas: up to about +1000 V.

Liquid which passes roller 26 should be relatively free of pigmented particles except in the region of the latent image.

Downstream of roller 26 there is preferably provided a rigidizing roller 30. Rigidizing roller 30 is preferably formed of a resilient polymeric material, for example a slightly conductive resilient polymeric material as described in either or both of U.S. Pat. Nos. 3,959,574 and 3,863,603 the disclosures of which are incorporated herein by reference. Roller 30 is preferably resiliently urged against photoconductive surface 16.

In a preferred embodiment of the invention, an electrically biased squeegee roller is used as roller 30. Roller 30 is negatively charged to a potential of at least several hundred and up to 2000 volts with the same sign as the charge on the pigmented toner particles, so that it repels similarly charged pigmented particles and causes them to more closely approach the image areas of the photoreceptor surface 16, thus compressing and rigidizing the image.

Downstream of rigidizing roller 30 there is provided an intermediate transfer member 40, which rotates in a direction opposite to that of photoreceptor surface 16, as shown by arrow 41, providing zero relative motion between their respective surfaces at the point of propinquity. Intermediate transfer member 40 is operative for receiving the toner image from photoreceptor surface 16 and for transferring the toner image to a receiving substrate 42, such as paper. Disposed internally of intermediate transfer member 40 there may be provided a heater 46, to heat intermediate transfer member 40.

Various types of intermediate transfer members are known and are described, for example in U.S. Pat. No. 4,684,238, PCT Publication WO 90/04216 and U.S. Pat. No. 4,974,027 the disclosures of all of which are incorporated herein by reference.

Following the transfer of the toner image to intermediate transfer member 40, photoreceptor surface 16 engages a cleaning station 49. This station may be any conventional cleaning station, comprising a cleaning roller 50 which may comprise a suitable resilient material such as foam polyethylene or neoprene. Cleaning roller 50 may be wetted by clean lubricating cleaning liquid, which preferably comprises liquid developer from which all or nearly all of the toner particles have been removed. Cleaning roller 50 is driven so that its surface moves opposite to surface 16 at their nip, to provide scrubbing action for removal of residual particles and carrier liquid from photoreceptor surface 16. A scraper 56 completes the removal of any residual toner which may not have been removed by cleaning station 49.

A lamp 58 completes the cycle by removing any residual charge, characteristic of the previous image, from semiconductor surface 16.

Transfer of the image to intermediate transfer member 40 is preferably aided by providing electrification of intermediate transfer member 40 to a voltage opposite that of the charged particles, thereby causing transfer by electrophoresis. It has been found by the inventors, that, at least for the preferred developer, raising the temperature of the developed toner image to a temperature higher than the development temperature and room temperature aids this first transfer, even when the transfer is by electrophoresis.

Subsequent final transfer of the image from intermediate transfer member 40 to substrate 42 is preferably aided by heat and pressure. A higher temperature than that used for first transfer is preferably utilized for this subsequent final transfer, in accordance with the present invention.

In the prior art a liquid toner image was first transferred to an intermediate transfer member. The toner image was heated during the interval between first and second transfer so as to aid in final transfer.

In the present invention the preferred first transfer step, i.e., the transfer of the liquid toner image to the intermediate transfer member includes the heating of the image either before or during first transfer. The preferred final transfer step, i.e., the transfer of the liquid toner image to the final substrate, includes the further heating of the image before and/or during second transfer. This further heating can be achieved by heating the image on intermediate transfer member 40, for example by heat transfer from intermediate transfer member 40 during the interval between first and final transfer and/or by external heating of the image. Preferably the image is heated to a temperature at which it solvates liquid to form a single phase, without evaporating substantial amounts of liquid carrier. Alternatively or additionally the further heating can be achieved by conduction heating of the image from the final substrate during final transfer.

These preferred first and second transfer steps improve the quality of the image on the final substrate both for single color and for multi-color images.

For multicolor systems it is useful to sequentially transfer the separate colors to intermediate transfer member 40 in alignment with and generally superimposed and in registration with each other and then to transfer them together to paper or other substrate 42. It has then been found that for this configuration, there is a tendency for the heated images previously transferred to the intermediate transfer member at a lower temperature, to transfer back, in whole or in part, to photoreceptor surface 16, when the previously transferred image returns to the point of first transfer.

The embodiments of the invention described herein provide improved first and final transfer and for multicolor systems can solve the back transfer problem.

In general, some of the embodiments of the invention are characterized in that photoreceptor 16 is at a first, relatively low temperature; intermediate transfer member 40 is at a second, somewhat higher temperature, to provide for improved first transfer; and final substrate 42 is at a third, even higher temperature to provide for good transfer from intermediate transfer member 40 to substrate 42.

Alternatively or additionally, some of the embodiments can be characterized in that, when a toner image is transferred from photoreceptor surface 16 to intermediate transfer member 40, and then to final substrate 42, the toner image is hotter during transfer to the intermediate transfer member than it was on the photoreceptor surface and the image is hotter when it is transferred to the final substrate, than during the earlier transfer.

Alternatively or additionally, some of the embodiments can be characterized in that, when multiple toner images are transferred sequentially from photoreceptor surface 16 to intermediate transfer member 40, and then to final substrate 42 as a group, the composite, multicolor toner image is hotter when it is transferred to the final substrate than during any contact of earlier transferred images with the photoreceptor.

One embodiment of the invention can be characterized in that the image is transferred from a photoreceptor surface, at a first relatively low temperature to a first intermediate transfer member at a second intermediate temperature. The image is then transferred to a second intermediate transfer member. Final transfer takes place from the second intermediate transfer member to the final substrate at a third, higher temperature. Preferably, the image temperature during first transfer is higher than that of that portion of the photoreceptor surface not in contact with the intermediate transfer member.

Returning now to FIG. 1, intermediate transfer member 40 is heated to a temperature sufficient to enhance the electrophoretic transfer of toner particles from photoreceptor surface 16 to intermediate transfer member 40. The image is heated during transfer to intermediate transfer member 40, and the heating continues while the image is on intermediate transfer member 40 until the image is at the temperature of intermediate transfer member 40. Rotation of intermediate transfer member 40 brings the heated intermediate transfer member 40 into image transfer relationship with a final substrate 42, which is pressed against the intermediate transfer member by a heated backing roller 43. Heated backing roller 43 heats the paper and thereby heats the image in contact therewith by conduction from the paper, to a sufficient degree to ensure that complete or nearly complete final transfer of the image to the substrate, by heat and pressure, takes place.

While the invention has been described in a monochromatic version, where it gives improved transfer from the photoreceptor to the intermediate transfer member and from the intermediate transfer member to the final substrate, the invention is particularly useful in a multicolor system, wherein images of different colors are sequentially formed on photoreceptor surface 16, and transferred one by one in mutual alignment to image transfer member 40 prior to a single transfer of all of the images, which form a multicolor image, to final substrate 42.

Final substrate 42 is brought into transfer engagement with intermediate transfer member 40 only when all of the colors have been transferred to intermediate transfer member 40, for final transfer of multicolor image to substrate 42.

As noted above, it is appreciated that during first transfer of subsequent images from photoreceptor surface 16 to image transfer member 40, earlier transferred images return to the region of first transfer. Any back transfer of previously transferred images to photoreceptor surface 16 will result in undesirable artifacts in the final printed image.

Generally if the intermediate transfer member is heated to a temperature which is useful for good final transfer, then there is tendency for the image to back transfer to the photoreceptor.

The arrangement of FIG. 1, with proper choice of temperatures for intermediate transfer member 40 at first transfer, and for final substrate 42 and the image at second transfer in accordance with the present invention, substantially eliminates the problem of back transfer to photoreceptor surface 16, by keeping the image temperature, when the image on the intermediate transfer member returns to the photoreceptor, low enough so that it is not tacky enough to stick to the photoreceptor.

Figure 2:
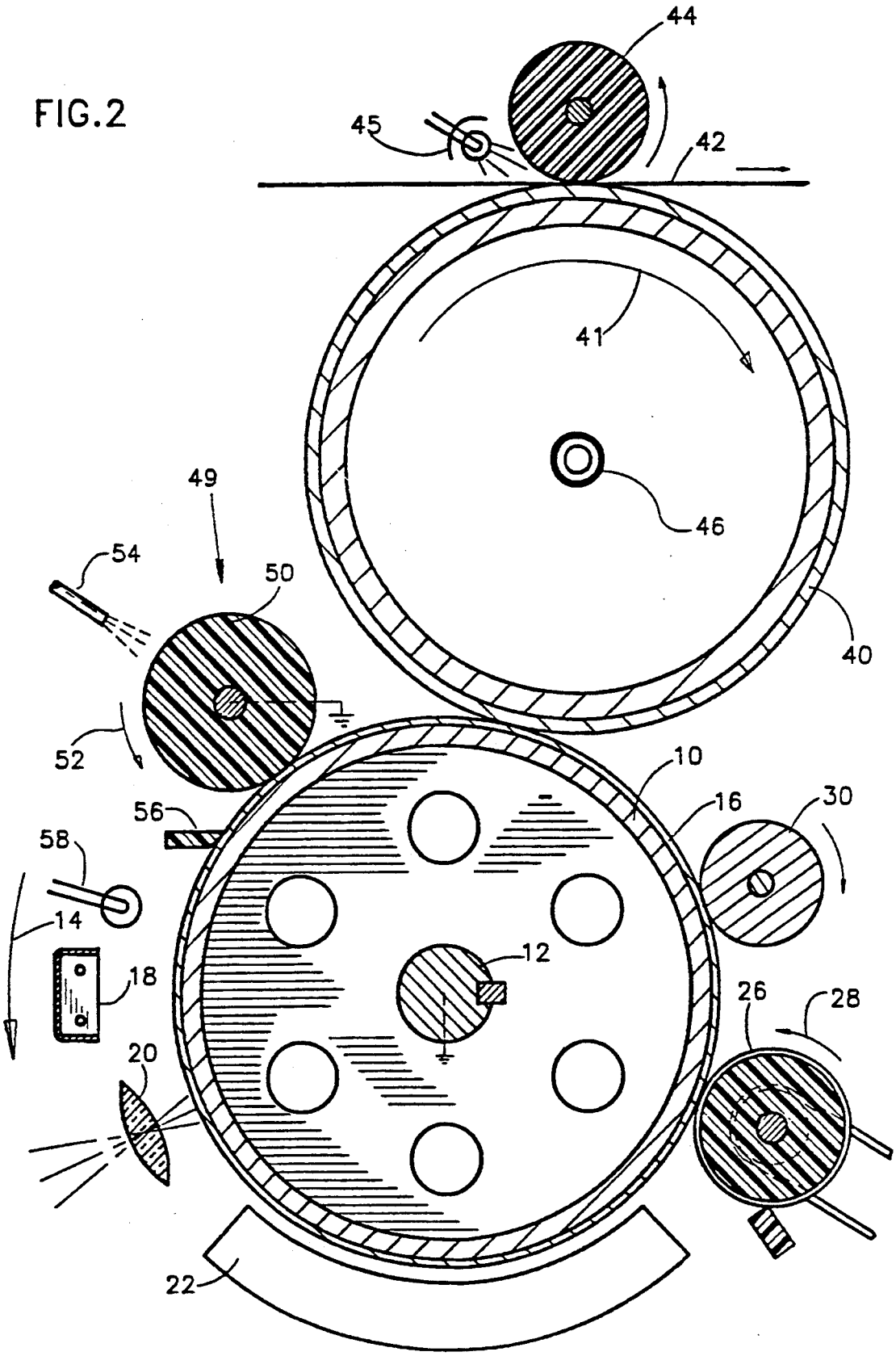
FIG. 2 is a simplified sectional illustration of electrophotographic apparatus constructed and operative in accordance with another preferred embodiment of the present invention.

FIG. 2 shows a second embodiment of the invention in which all of the parts and operation are generally the same as those of the apparatus of FIG. 1, except that heated backing roller 43 is replaced by an unheated backing roller 44, and final substrate 42 is preheated by heating lamp 45. A combination of the embodiments of FIGS. 1 and 2 is also useful, whereby paper 42 is preheated by lamp 45, and heated roller 43 is used.

Figure 3A:
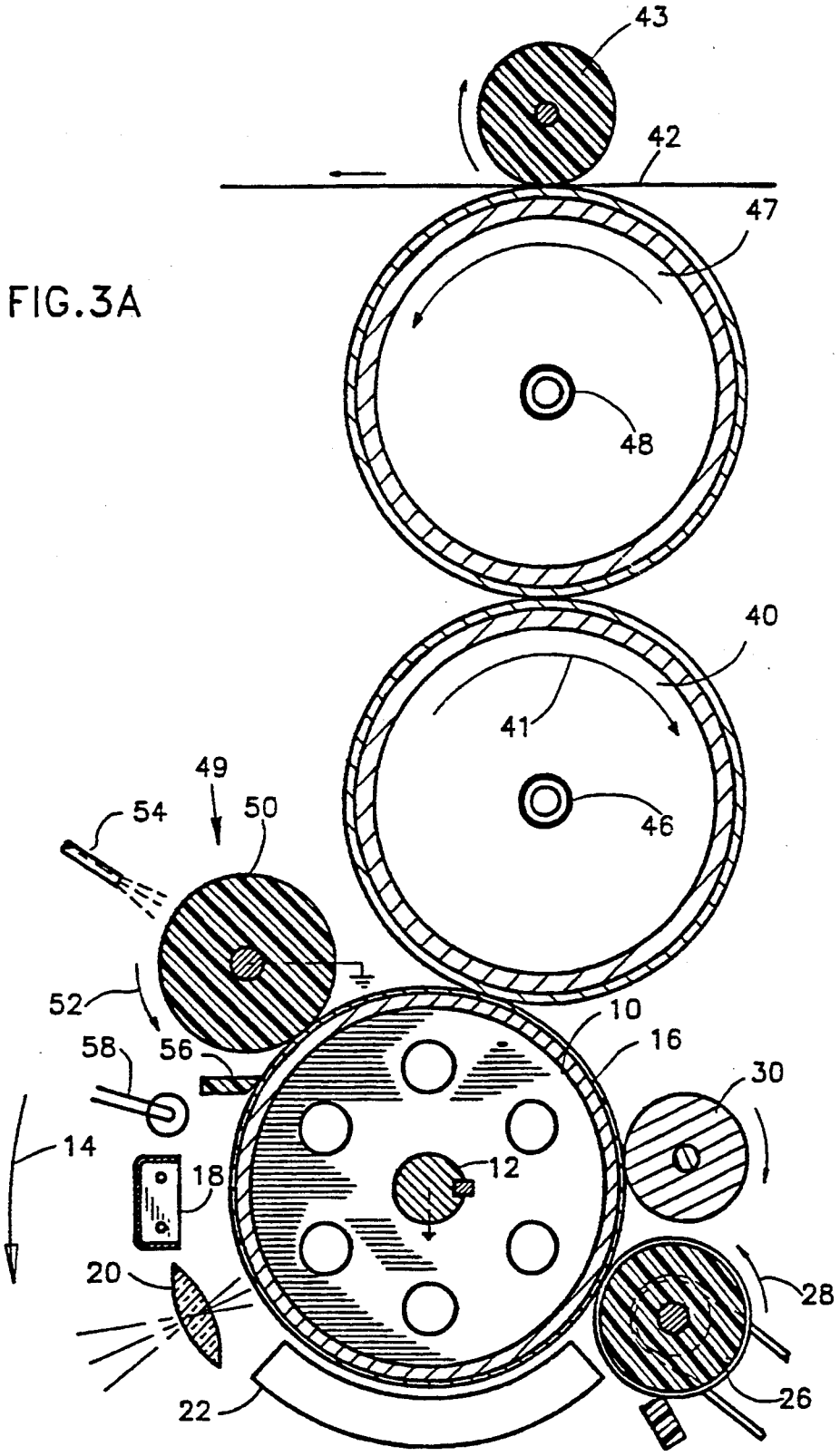
FIG. 3A is a simplified sectional illustration of electrophotographic apparatus constructed and operative in accordance with yet another preferred embodiment of the present invention.

A third embodiment of the apparatus of the invention is shown in FIG. 3A. In this case intermediate transfer member 40 is heated to a first, moderate, temperature which is high enough to enhance first transfer, but not so high as to cause substantial back transfer of previously transferred images from intermediate transfer member 40 to photoreceptor surface 16. The images are transferred to a second intermediate transfer member 47 which is heated by an internal heater 48 to a higher temperature, sufficient to assure good final transfer to final substrate 42.

In a preferred embodiment of the invention, intermediate transfer member 40 is maintained at a first voltage (different from the voltage of the photoreceptor surface 16) to enhance transfer of the image thereto from photoreceptor surface 16, and second intermediate transfer member 47 is electrified to a second voltage, different from the first voltage, to enhance transfer of the image thereto from intermediate transfer member 40.

Transfer to second intermediate transfer member 47 can occur sequentially for each of the images, or preferably the images are collected on first intermediate transfer member 40 and then the multicolor image is transferred as a whole to second intermediate transfer member 47 for final transfer to the final substrate 42.

Figure 3B:
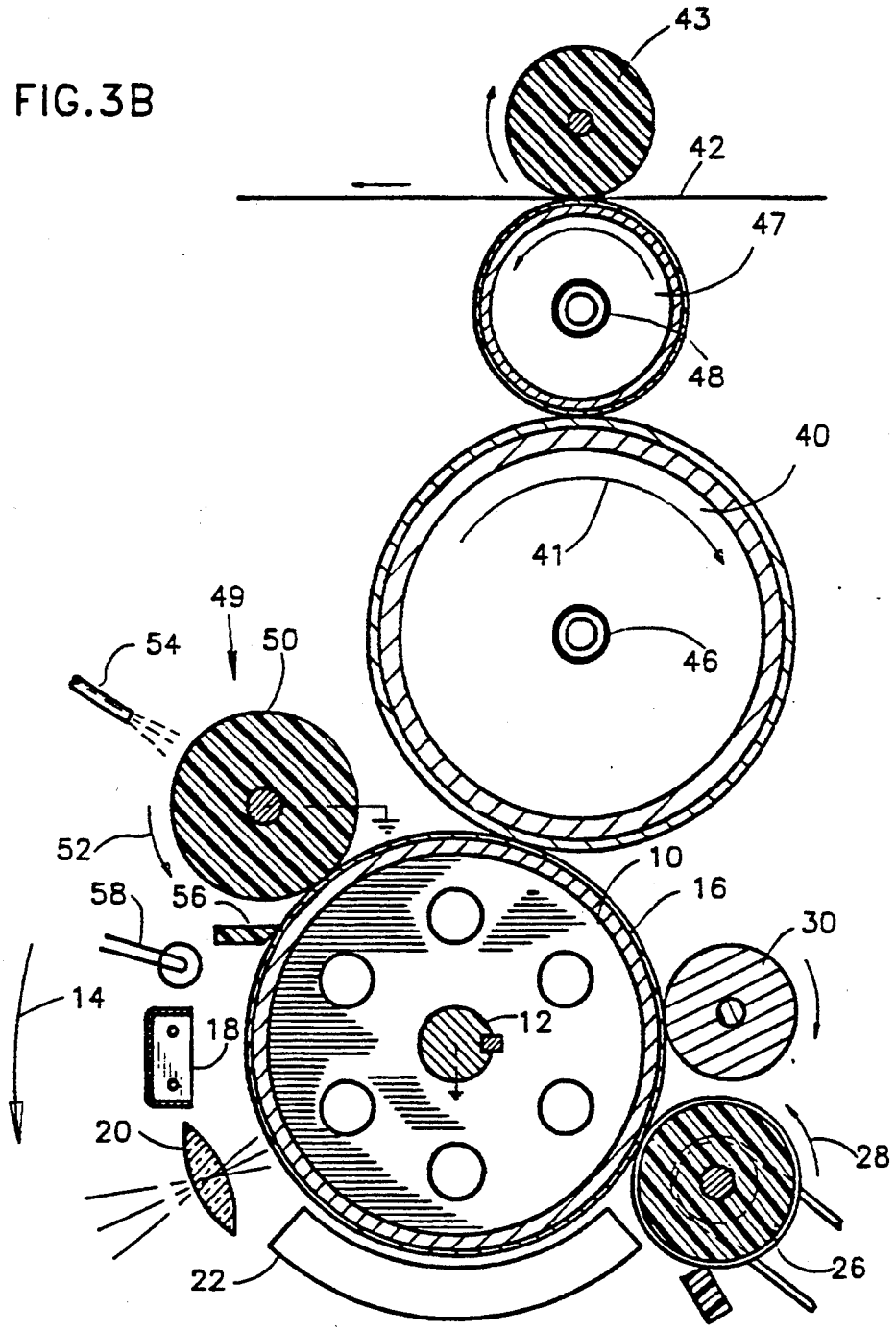
FIG. 3B is a simplified sectional illustration of electrophographic apparatus constructed and operative in accordance with yet another preferred embodiment of the present invention.

Another embodiment of the apparatus of the invention is shown in FIG. 3B which is identical to the embodiment shown in FIG. 3A except that second intermediate transfer member 47 has a smaller diameter and in consequence has less surface area. In this embodiment, second intermediate transfer member 47 cannot hold at any one moment in time the complete latent image which is being transferred from first intermediate transfer member 41. Thus, when the image is multicolor, all the multicolor images are first collected on the first intermediate transfer member and only thereafter is the composite image transferred to the second intermediate transfer member.

In this embodiment, the latent image is transferred from the second intermediate transfer member to final substrate 42 virtually simultaneously as it is being transferred to second intermediate transfer member 47 from first intermediate transfer member 41. The inventors have discovered that this configuration results in an enhancement of the quality of the image produced on the final substrate when compared with a configuration in which the second intermediate transfer member is full-sized. In the latter case, the final substrate tends to adhere to the surface of the second intermediate transfer member as the image is being transferred, thereby causing a certain blurring of the image on the final substrate. When the second intermediate transfer member has a relatively small diameter, preferably less than 40 mm and more preferably less than 30 mm, the separation of the final substrate from the transfer member is improved, there is less tendency to adhesion, and the quality of the image on the final substrate is thereby enhanced. In particular when the first intermediate transfer member has a diameter of 70 mm or more, as required to hold an A4 sized image, or a 100 mm diameter or more, as required to hold an A3 sized image, optimal results will be obtained when intermediate transfer member 47 has a diameter of less than about 40 mm or less, preferably about 30 mm or less.

Figure 4:
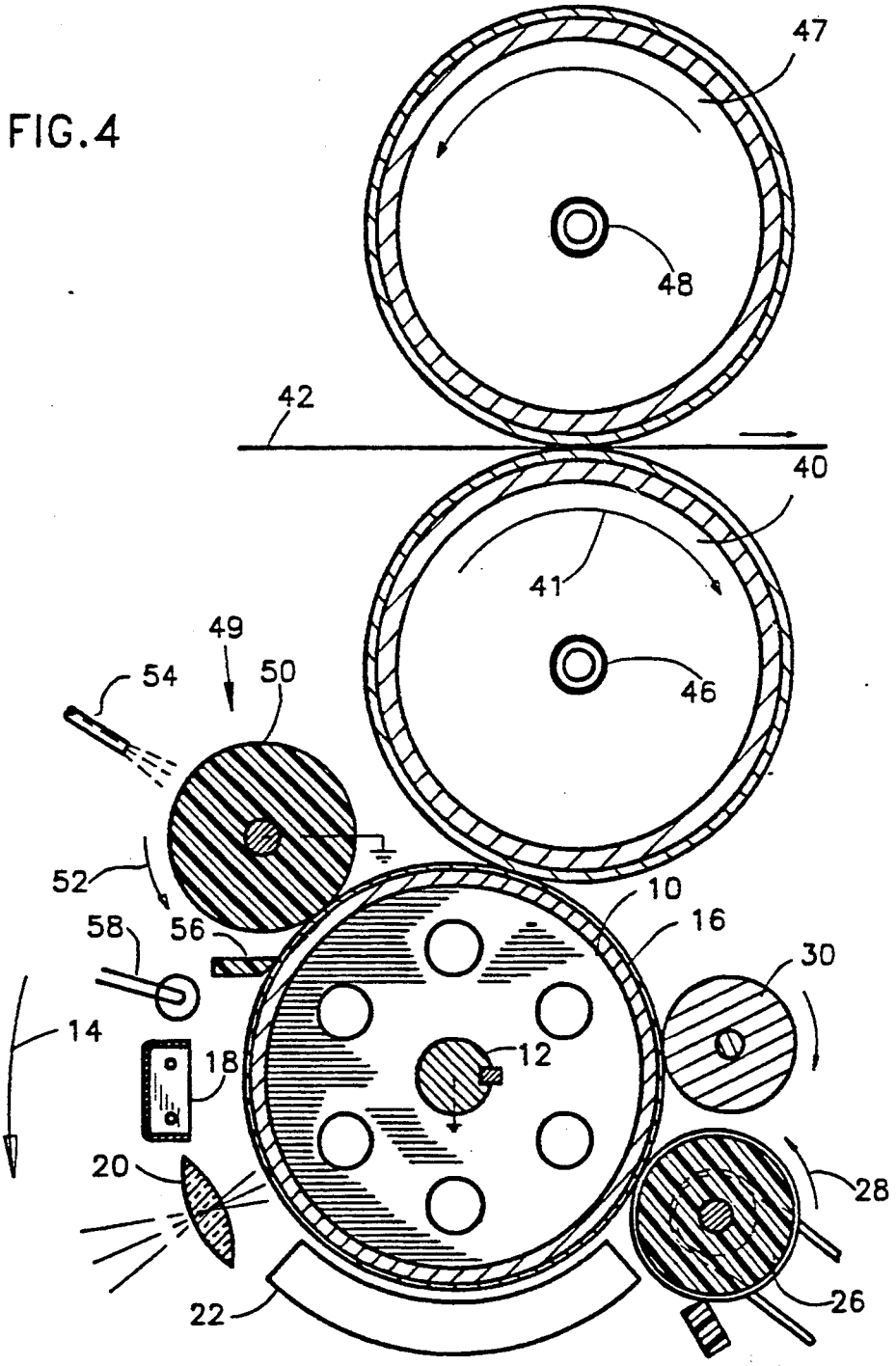
FIG. 4 is a simplified sectional illustration of a electrophotographic apparatus constructed and operative in accordance with yet another preferred embodiment of the present invention.

A duplex embodiment of the invention, for printing two sides of a substrate at the same time is shown in FIG. 4. The separate color images which make up the multicolored image to be printed on a first side of substrate 42 are first transferred sequentially to intermediate transfer member 40 and then are transferred, preferred as a group, to second intermediate transfer member 47. Second image transfer member 47 is preferably heated to a higher temperature than intermediate transfer member 40. The images to be printed on the other side of the page are subsequently transferred sequentially to intermediate transfer member 40, which is meanwhile kept out of the transfer engagement with second intermediate transfer member 47.

Final substrate 42 is then passed between intermediate transfer member 40 and second intermediate transfer member 47, while pressing the two intermediate transfer members together to effect transfer of the images to both sides of the paper by heat and pressure. It is understood that preferably second intermediate transfer member 47 heats substrate 42 and the image to a suitable temperature to assure good transfer of the image on intermediate transfer member 40 to substrate 42. Alternatively or additionally, the paper may be heated before transfer as described above in connection with FIG. 2.

In some preferred embodiments of the invention intermediate transfer member 40 acts to heat the image to a first temperature during first transfer from photoreceptor 16 to intermediate transfer member 40, and to heat the image to a second higher temperature before second and final transfer from intermediate transfer member 40 to final substrate 42.

Figure 5:
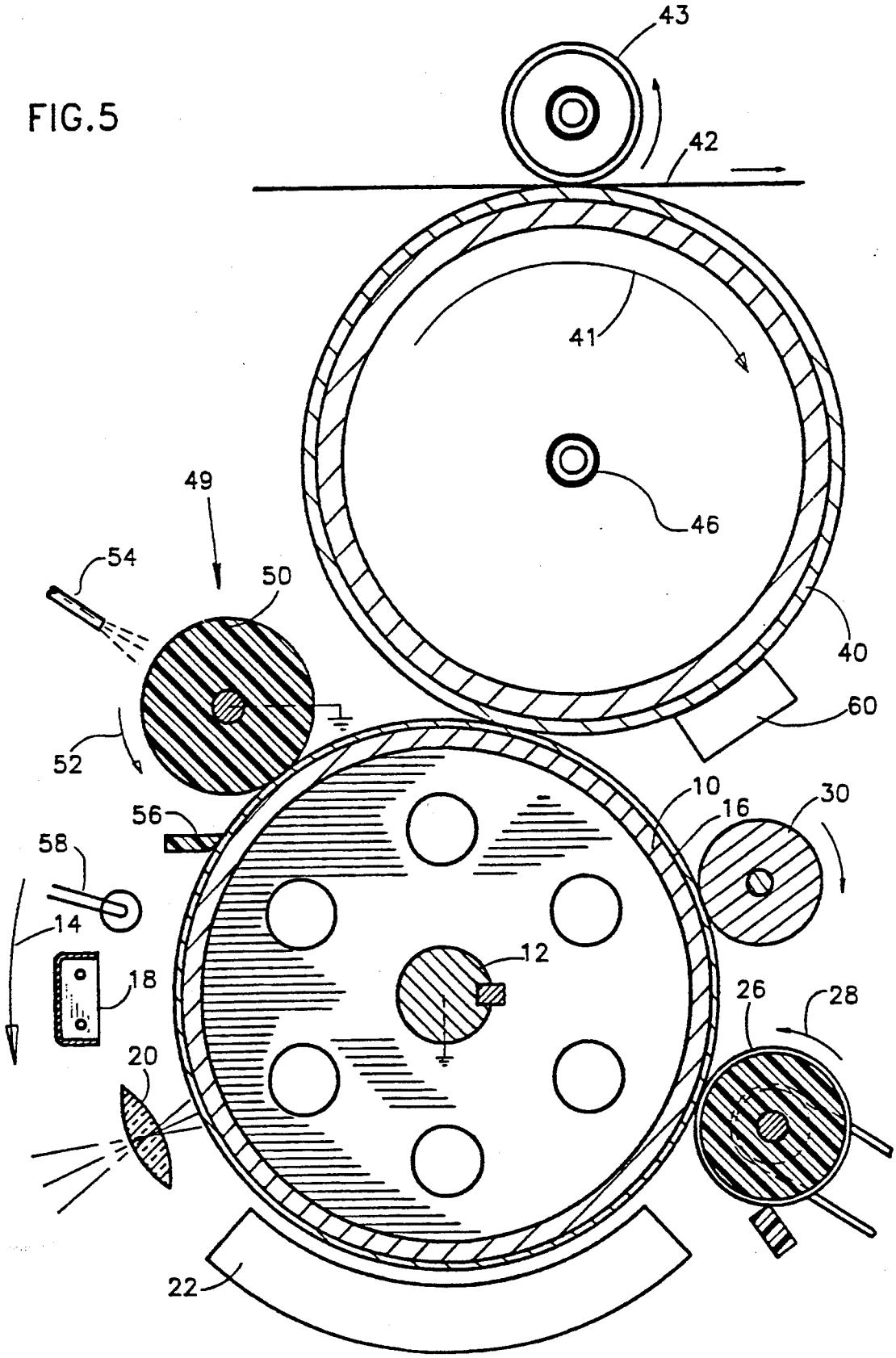
FIG. 5 is a simplified sectional illustration of electrophotographic apparatus constructed and operative in accordance with yet another preferred embodiment of the present invention.

Exemplary embodiments include the apparatus shown in FIG. 5. This apparatus is generally the same as the apparatus of FIG. 1, except that a cooling station 60 is operatively associated with intermediate transfer member 40 just before it returns to make contact with photoreceptor surface 16. Intermediate transfer member 40 is cooled at cooling station 60 to locally reduce the temperature of intermediate transfer member 40 before and during contact with the image on the photoreceptor. This local cooling allows the liquid toner image to be hotter at the point of final transfer from intermediate transfer member 40 to final substrate 42 than it is at first transfer from photoreceptor surface 16 to intermediate transfer member 40.

Cooling station 60 may comprise, for example, apparatus for providing a stream of cool air to the surface of the photoreceptor or a cooled roller in contact with the photoreceptor surface. Either or both cooling systems cool intermediate transfer member 40 to a temperature, higher than room temperature, but lower than the final transfer temperature.

In a multicolor system, if a roller cooler is used it is coated with a non-stick coating to avoid transfer of the image from intermediate transfer member 40 to the roller of cooling station 60.

Figure 6:
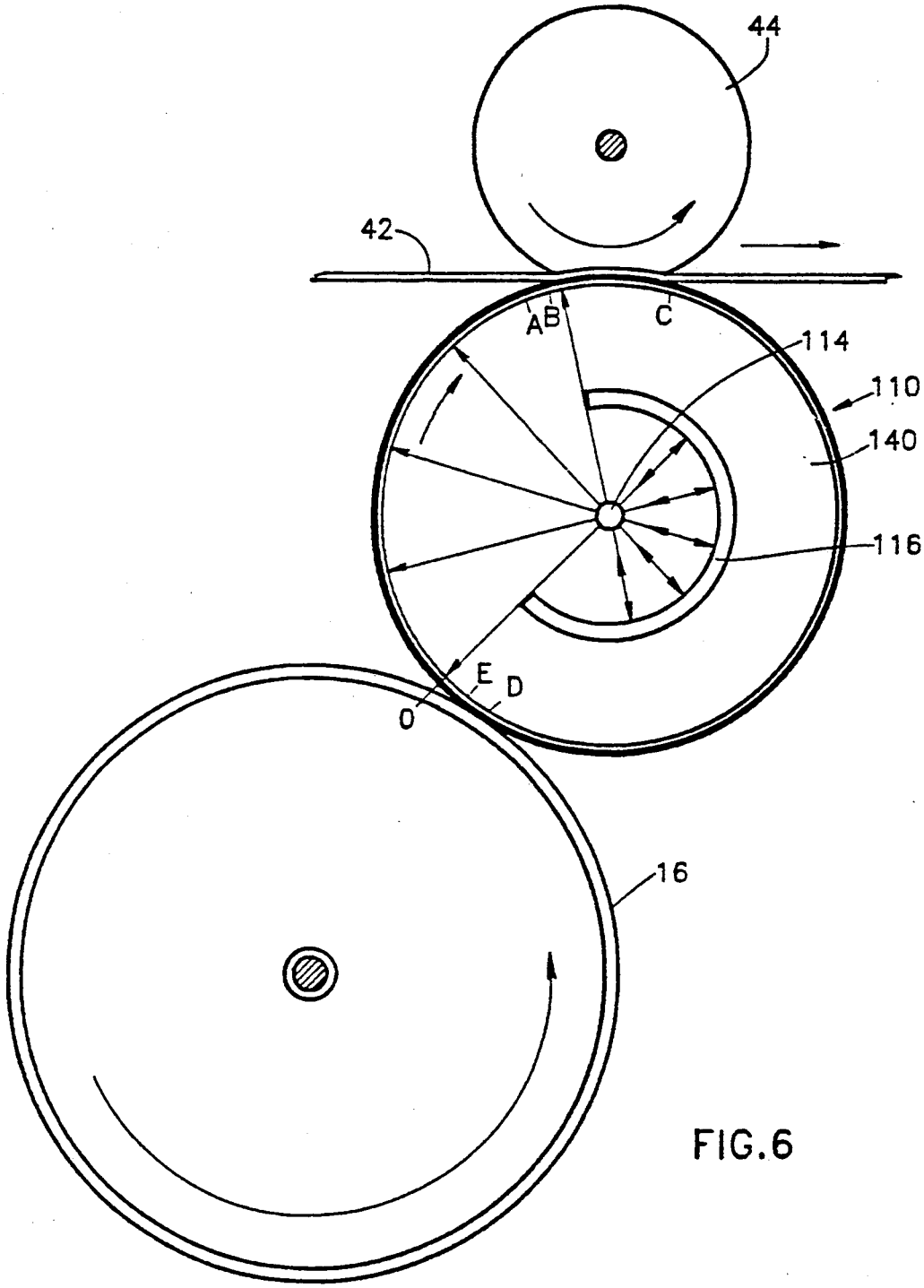
FIG. 6 is a simplified sectional illustration of electrophotographic apparatus constructed and operative in accordance with yet another preferred embodiment of the present invention.
Figure 7:
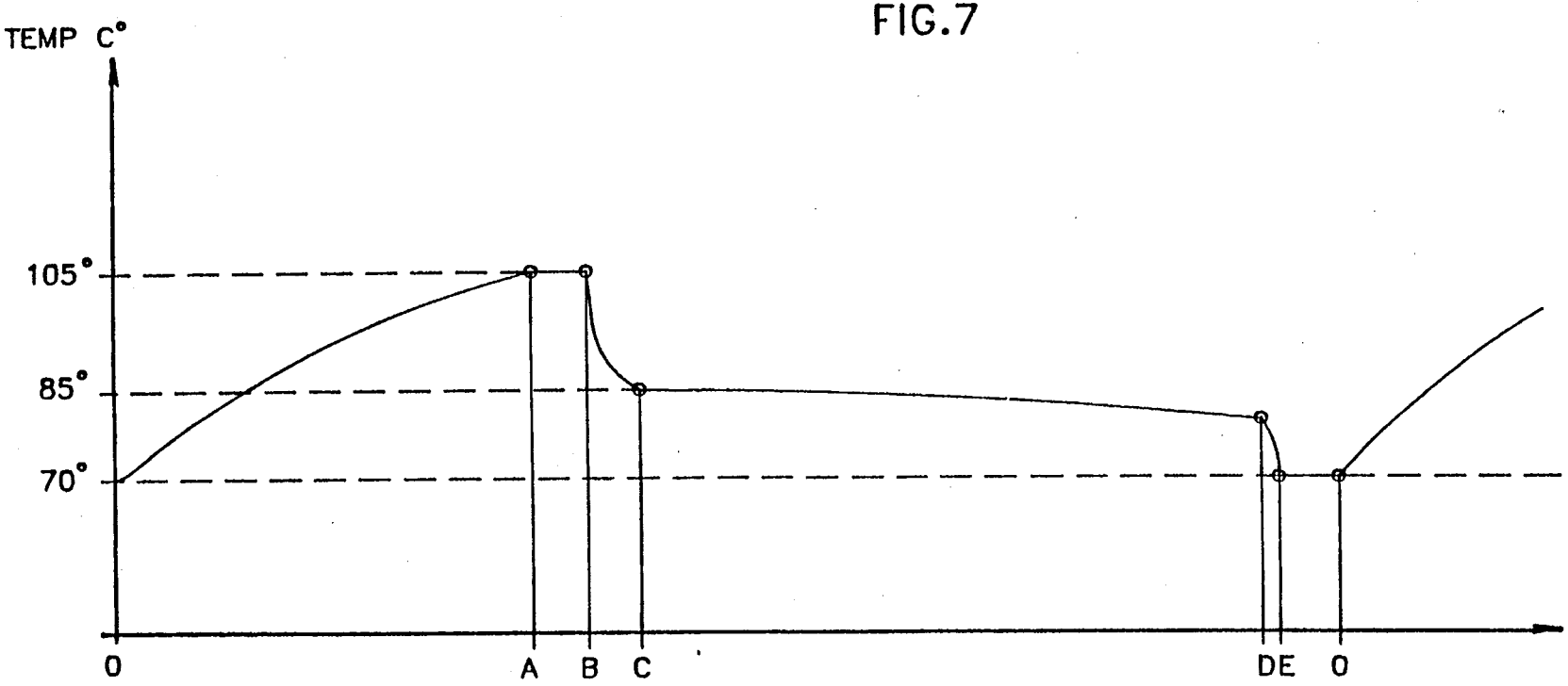
FIG. 7 is a graphical illustration of the temperature variation along a low thermal mass intermediate transfer member in an arrangement such as that illustrated in FIG. 6.

Another exemplary embodiment of this type is illustrated in FIG. 6, which is essentially the same as FIG. 8 of WO 90/04216 previously referenced. Here an intermediate transfer member 140 is of low heat capacity, and is heated only after first transfer is completed. As shown in FIG. 7, which is the same as FIG. 9 of the above referenced application, the temperature at the first transfer is above room temperature in order to improve first transfer, and the temperature at second transfer is even higher to assure complete or nearly complete second transfer. For a multi-color system the temperatures and heat capacities are selected so that the first transfer takes place at a temperature low enough to avoid back transfer.

In the above embodiments, intermediate transfer members 40 and 47 have been described as having heaters placed internal to the core to heat each of them to its required temperature. Other methods of heating intermediate transfer members known in the art can also be used in the practice of the invention.

EXAMPLES

Colored liquid developer is prepared in the following manner:

Preparation of Black Liquid Developer 10 parts by weight of Elvax 5720 (E. I. Du Pont) and 5 parts by weight of Isopar L are mixed at low speed in a jacketed double planetary mixer connected to an oil heating unit for one hour, the heating unit being set at 130° C.

A mixture of 2.5 parts by weight of Mogul L carbon black (Cabot) and 5 parts by weight of Isopar L are then added to the mix in the double planetary mixer and the resultant mixture is further mixed for one hour at high speed. 20 parts by weight of Isopar L preheated to 110° C. are added to the mixer and mixing is continued at high speed for one hour. The heating unit is then disconnected and mixing is continued until the temperature of the mixture drops to 40° C.

The resulting mixture is transferred to an S-1 attritor device equipped with 3/16 inch carbon steel media, diluted with Isopar L to a 16% solids ratio and ground without cooling until the temperature rises to about 60° C. Cooling, which reduces the temperature to about 30° C. is then commenced and grinding is continued for a total of 24 hours. The mixture is removed from the device and diluted with Isopar L to 1.5% by weight solids concentration. The particles in the resultant toner concentrate have an average diameter of 2.5 microns.

Charge director as known in the art, is added to give the final liquid developer. In a preferred embodiment of the invention the charge director of Example 1 of PCT publication WO 90/14617 the disclosure of which is incorporated herein by reference, is added to give the final liquid developer.

Preparation of Colored Developer 10 parts by weight of Elvax 5720 (E. I. Du Pont) and 5 parts by weight of Isopar L are mixed at low speed in a jacketed double planetary mixer connected to an oil heating unit for one hour, the heating unit being set at 130° C.

Pre-heated Isopar L is then added to reduce the solids concentration to preferably 35% and mixing is continued at high speed for one hour. The heating unit is then disconnected and mixing is continued until the temperature of the mixture drops to 40° C.

The mixture is then transferred to an S-1 attritor device equipped with 3/16 inch carbon steel media and pigment is added to the material in the attritor. The mixture is diluted with Isopar L to about a 12–16% solids ratio, depending on the viscosity of the material and is ground without cooling until the temperature rises to about 60° C. Cooling, which reduces the temperature to about 30° C., is then commenced and grinding is continued for a total of 24 hours. The mixture is removed from the device and diluted with Isopar L to 1.5% by weight solids concentration. The particles in the resultant toner concentrate had an average diameter of 2.5 microns.

Charge director as known in the art, is added to give the final liquid developer. In a preferred embodiment of the invention the charge director of Example 1 the above referenced PCT publication WO 90/14617 is added to give the final liquid developer.

Appropriate colored pigments known in the art of liquid developer manufacture, for example the list given in U.S. Pat. No. 4,794,651 can be used. Other suitable pigments are Sisco Fast Yellow D1350 (BASF), Lithol Rubin D4576 (BASF), Lyonol blue FG7351 (TOYO) and Lyonol Yellow 7G1310 (TOYO). in amounts and combinations depending on the color and intensity required. Optionally, Aluminum Stearate can be added in small amounts. For pigments which are discolored by steel, other grinding media such as zirconia may be used.

These developers are used to form the individual color liquid toner images on photoreceptor surface 16 which comprise a relatively high concentration of toner particles in carrier liquid.

Photoreceptor surface 16 is preferably formed of selenium. Intermediate transfer member 40 is preferably formed of a cylindrical aluminum core coated with a 1 nm thick layer of very soft polyurethane having a hardness of 20–25 Shore A. This layer is covered by an offset printing blanket, preferably a KYNIO AIRTRACK offset blanket, which is much harder than the polyurethane. A thin conducting layer of conducting acrylic covers this layer and is covered in turn by a 0.1 mm layer of polyurethane of shore A Hardness 20. This layer is overcoated by a thin layer of Syl-Off type 291 or 294 silicone release coating.

Liquid developer prepared in accordance with the method described above is used in the equipment of FIG. 1. Preferably the temperature of the intermediate transfer layer should be less than about 50° C. For temperatures greater than about 50 degrees, there is a tendency for the previously transferred colors to back transfer to photoreceptor surface 16. Heating intermediate transfer member 40 improves image transfer to intermediate transfer member 40. Intermediate transfer member 40 is preferably heated to a temperature somewhat below that at which back transfer begins to occur.

It is believed that the improvement in first transfer when the intermediate transfer member is heated may be a consequence of partial solvation of carrier liquid by the pigmented toner particles in the image.

One characteristic of the liquid developers preferred in the practice of this invention is that the pigmented toner particles contained therein solvate the carrier liquid at elevated temperatures. It is believed that there is a partial solvation of the carrier liquid in the toner particles during first transfer to heated intermediate transfer member 40 which may cause the particles to partially coalesce and form a film during first transfer. Coalesced toner is believed to transfer better than uncoalesced toner particles.

Furthermore, when the toner material solvates some of the carrier liquid, the toner particles separate from the unsolvated carrier liquid. It is believed that this separated carrier liquid forms a film between the toner image and the photoreceptor which reduces the adhesion of the image to the photoreceptor, aiding complete transfer of the image to the intermediate transfer member.

It is to be understood that the heating of the image before and/or during final transfer insures the complete or nearly complete transfer of the image from the intermediate transfer member to the final substrate. Where this image heating comes solely by conduction from the paper, it has been found experimentally that the paper should be at a temperature of at least about 70° C. Higher tempertures such as 80° or 90° can also be used, but substantially lower temperatures do not tackify the image enough to assure complete transfer from intermediate transfer member 40 to paper 42.

The precise temperatures used for particular configurations and combinations are a function of the material properties of the toner particles and the carrier liquid as well as of the quality of the release layer on the intermediate transfer member. Back transfer occurs due to the tackiness of the image, but is also influenced by the relative adhesion of the image to the release layer on the intermediate transfer member and to the photoreceptor. It would be possible to increase the temperature of the intermediate transfer member if the release properties of the surface of the intermediate transfer member were poorer. This however would also result in poorer transfer to the final substrate.

In particular representative, operating examples the following temperatures are used. In a first example, which is used for the transfer of single color images, the intermediate transfer member is heated to a surface temperature of 100° C. and the paper is not heated. Calculations show that the image is at a temperature of 52° C. to 63° C. during first transfer. During the interval between first and second transfer the image temperature rises to the intermediate transfer member's temperature of 100° C., and the image is cooled during second, final transfer to paper to a temperature of 73° C. to 78° C.

In a second, representative, operating example for sequential transfer of multiple images to the intermediate transfer member, the intermediate transfer member is heated to 50° C. and backing roller 43 is heated to 120° C. The image temperature on first transfer is approximately 43° C. and on second transfer it is 75° C. to 78° C.

The temperatures shown in FIG. 7 are also representative of values suitable for single image transfer. For multi-image transfer to intermediate transfer member 140, the first transfer temperature must be low enough to assure that no back transfer takes place.

It will be understood that certain features and sub-combinations of the invention are useful, and may be employed without other features and sub-combinations. It is noted that various changes may be made in details within the scope of the claims without departing from the spirit of the invention. It is therefore to be understood that the invention is not to be limited to the specific details shown and described.

I claim:

1. Imaging apparatus for printing an image on a substrate from a latent image formed on a latent image bearing surface comprising:

developing means (22) for developing the latent image with toner to form a developed toner image of a given size;

a first cylindrical intermediate transfer member (40) having a first diameter;

first transfer means for transferring the developed toner image from the latent image bearing surface to the first cylindrical intermediate transfer member;

a second cylindrical intermediate transfer member (47); and second transfer means for transferring of the developed image from the first intermediate transfer member to the second intermediate transfer member and from the second intermediate transfer member to the substrate, characterized in that the second cylindrical intermediate transfer member has a diameter not insubstantially smaller than the diameter of the first cylindrical intermediate transfer member.

2. Imaging apparatus according to claim 1 wherein the first cylindrical intermediate transfer member has a surface area large enough to accommodate the developed toner image.

3. Imaging apparatus according to claim 1 wherein the second intermediate transfer member is not large enough to accomodate the developed image.

4. Imaging apparatus according claim 1 and including:

intermediate transfer member heating means (46, 48) for heating the first intermediate transfer member to a first temperature and for heating the second intermediate transfer member to a second temperature higher than the first temperature.

5. Imaging apparatus according claim 1 wherein the second transfer means includes a second heating means (43) for heating the substrate.

6. Imaging apparatus according to claim 5 wherein the second heating means comprises a heating backing roller (43) operative to apply heat and pressure to the image during the image transfer.

7. Imaging apparatus according to claim 1 claims and also including first voltage means for maintaining the first intermediate transfer member at a first voltage.

8. Imaging apparatus according to claim 7 wherein at least a portion of the latent image bearing surface is at a second voltage and the first voltage is different from the second voltage.

9. Imaging apparatus according to claim 7 and also including second voltage means for maintaining the second intermediate transfer member at a third voltage.

10. Imaging apparatus according to claim 1 wherein the toner is a liquid toner comprising carrier liquid and toner particles.

11. Imaging apparatus according to claim 1 wherein the second cylindrical intermediate transfer member has a diameter of less than about 40 mm.

12. Imaging apparatus according to claim 1 wherein the second cylindrical intermediate transfer member has a diameter of less than about 30 mm.

13. Imaging apparatus according to claim 1 wherein transfer of the developed image from the second cylindrical intermediate transfer member to the substrate commences before transfer of the developed image from the first intermediate transfer member to the second transfer member is complete.

14. Imaging apparatus according to claim 1 wherein the apparatus includes means for producing a plurality of developed images on the image bearing surface and for transferring the plurality of developed images to the first cylindrical transfer member in mutual alignment thereon.

* * * * *